US009291334B2

(12) United States Patent
Grassi

(10) Patent No.: US 9,291,334 B2
(45) Date of Patent: Mar. 22, 2016

(54) WALL WASH LIGHTING SYSTEM

(71) Applicant: Lumenpulse Lighting Inc., Montreal (CA)

(72) Inventor: David Michael Grassi, Quincy, MA (US)

(73) Assignee: LUMENPULSE LIGHTING INC., Montreal (CA)

( * ) Notice: Subject to any disclaimer, the term of this patent is extended or adjusted under 35 U.S.C. 154(b) by 0 days.

(21) Appl. No.: 14/287,349

(22) Filed: May 27, 2014

(65) Prior Publication Data

US 2015/0345749 A1 Dec. 3, 2015

(51) Int. Cl.

| | |
|---|---|
| ***F21S 8/00*** | (2006.01) |
| ***F21V 7/00*** | (2006.01) |
| ***F21V 3/00*** | (2015.01) |
| ***F21V 13/14*** | (2006.01) |
| ***F21V 13/12*** | (2006.01) |
| ***F21V 5/00*** | (2015.01) |
| ***F21S 8/10*** | (2006.01) |
| ***F21V 5/08*** | (2006.01) |
| *F21Y 101/02* | (2006.01) |

(52) U.S. Cl.

CPC ..... *F21V 13/14* (2013.01); *F21S 8/032* (2013.01); *F21S 8/033* (2013.01); *F21S 48/1283* (2013.01); *F21V 5/002* (2013.01); *F21V 5/08* (2013.01); *F21V 13/12* (2013.01); *F21Y 2101/02* (2013.01)

(58) Field of Classification Search

CPC ..... F21S 8/033; F21S 8/032; F21S 48/1283; F21V 13/12; F21V 13/14; F21V 5/002; F21V 5/0045

USPC ..... 362/147, 308, 299, 300, 309, 311.02

See application file for complete search history.

(56) References Cited

U.S. PATENT DOCUMENTS

| | | | | |
|---|---|---|---|---|
| 4,799,136 | A | 1/1989 | Molnar | |
| 6,196,694 | B1 * | 3/2001 | Rochel et al. | 362/86 |
| 6,443,594 | B1 * | 9/2002 | Marshall et al. | 362/244 |
| 7,226,185 | B2 * | 6/2007 | Dolgin et al. | 362/239 |
| 7,665,874 | B2 * | 2/2010 | Chadwell et al. | 362/561 |

(Continued)

FOREIGN PATENT DOCUMENTS

| | | |
|---|---|---|
| EP | 2708806 | 3/2014 |
| WO | 2013010767 | 1/2013 |

OTHER PUBLICATIONS

International Search Report mailed on Aug. 13, 2015 in International Application No. PCT/US2015/031932 filed May 21, 2015.

*Primary Examiner* — Robert May
*Assistant Examiner* — Bryon T Gyllstrom
(74) *Attorney, Agent, or Firm* — Burns & Levinson LLP; Joseph M. Maraia

(57) ABSTRACT

An illumination system for illuminating a surface includes an optical source for generating light. An asymmetric optic device generates output light by total internal reflection (TIR) of the light from the optical source, intensity of the output light being asymmetric with respect to an axis of the asymmetric optic device. A diffuser receives and diffuses the output light from the asymmetric optic device to generate diffused light. A cover lens receives the diffused light from the diffuser. The cover lens has an etched portion for scattering a portion of the diffused light to generate an output light pattern, the output light pattern having an intensity profile that is asymmetric with respect to the axis of the asymmetric optic device.

11 Claims, 8 Drawing Sheets

(56) References Cited

U.S. PATENT DOCUMENTS

| | | | | |
|---|---|---|---|---|
| 2006/0082989 | A1* | 4/2006 | Wang | 362/153 |
| 2007/0247856 | A1* | 10/2007 | Wang et al. | 362/297 |
| 2008/0062686 | A1* | 3/2008 | Hoelen et al. | 362/240 |
| 2010/0110693 | A1* | 5/2010 | Bremerich | 362/296.01 |
| 2011/0255291 | A1* | 10/2011 | Seki et al. | 362/297 |
| 2012/0039077 | A1* | 2/2012 | Householder | 362/308 |
| 2014/0104865 | A1* | 4/2014 | Hutchins | 362/516 |
| 2014/0160724 | A1* | 6/2014 | Lerman | 362/84 |

* cited by examiner

WALL WASH LIGHTING SYSTEM

BACKGROUND

1. Technical Field

This disclosure relates to lighting systems, and, more particularly, to wall wash lighting systems.

2. Discussion of Related Art

In interior and exterior lighting systems, it is often desirable to illuminate a vertical or nearly vertical wall. Such lighting systems, the goal of which is to provide uniform illumination of the vertical surface of the wall, are commonly referred to as "wall wash" systems. In typical conventional wall wash systems, a uniform distribution of light or illumination over the surface of the wall is difficult to obtain.

SUMMARY

According to one aspect, an illumination system for illuminating a surface is provided. The illumination system includes an optical source for generating light. An asymmetric optic device generates output light by total internal reflection (TIR) of the light from the optical source, intensity of the output light being asymmetric with respect to an axis of the asymmetric optic device. A diffuser receives and diffuses the output light from the asymmetric optic device to generate diffused light. A cover lens receives the diffused light from the diffuser. The cover lens has an etched portion for scattering a portion of the diffused light to generate an output light pattern, the output light pattern having an intensity profile that is asymmetric with respect to the axis of the asymmetric optic device.

In some exemplary embodiments, the illumination system is a wall wash illumination system.

In some exemplary embodiments, the surface being illuminated is substantially parallel to the axis of the asymmetric optic device.

In some exemplary embodiments, the surface being illuminated is a surface of a wall. The illumination system can be vertically located beneath ground level. The axis of the asymmetric optic device can be substantially perpendicular to a surface of the ground in which the illumination system is located.

In some exemplary embodiments, the diffuser is an elliptical diffuser.

In some exemplary embodiments, the optical source comprises a light-emitting diode (LED).

BRIEF DESCRIPTION OF THE DRAWINGS

The present disclosure is further described in the detailed description which follows, in reference to the noted plurality of drawings by way of non-limiting examples of embodiments of the present disclosure, in which like reference numerals represent similar parts throughout the several views of the drawings.

DETAILED DESCRIPTION

Figure 1:
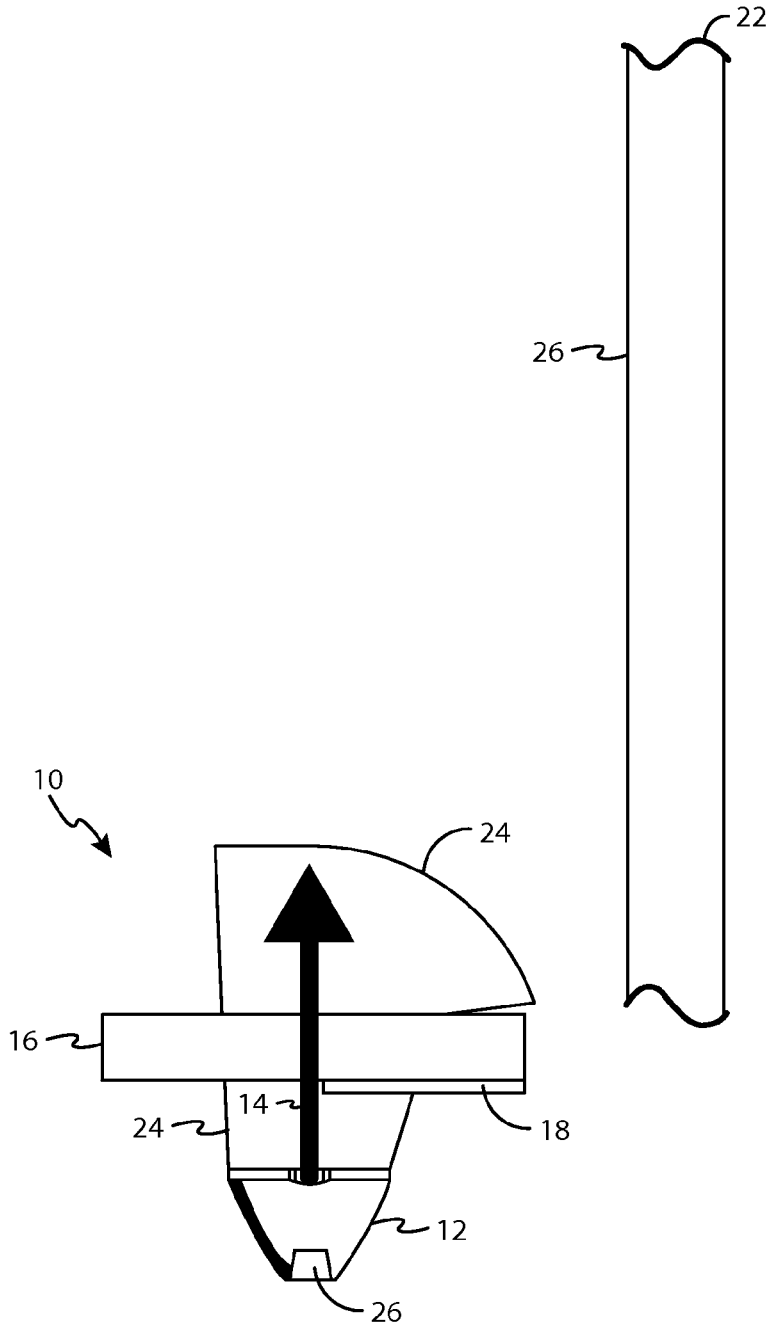
FIG. 1 includes a schematic cross-sectional view of a conventional wall wash lighting system.

FIG. 1 includes a schematic cross-sectional view of a conventional wall wash lighting system 10. Lighting system 10 includes a symmetric total internal reflection (TIR) optic 12, which emits a light pattern 24 having a primary direction as illustrated by arrow 14 to illuminate a surface 20 of a wall 22. Symmetric TIR optic 12 includes a light source 26, which emits light 24 primarily along the direction indicated by arrow 14. The light 24 emitted by TIR optic 12 passes through a glass cover lens 16, which can include an etched portion 18. Etched portion 18 of cover lens 16 diffuses the light 24 such that the light is emitted from glass cover lens 16 in light pattern 24 as shown in FIG. 1.

Since wall 22 is located laterally some distance or setback from lighting system 10, symmetric TIR optic 12 and cover lens 16 are tilted toward wall 22 as shown. This tilt is intended to provide additional illumination on wall 22. However, in general, such conventional tilt systems provide wall wash illumination which is non-uniform both in the vertical dimension, i.e., up and down wall 22, and the horizontal dimension, i.e., side-to-side on wall 22.

Figure 2:
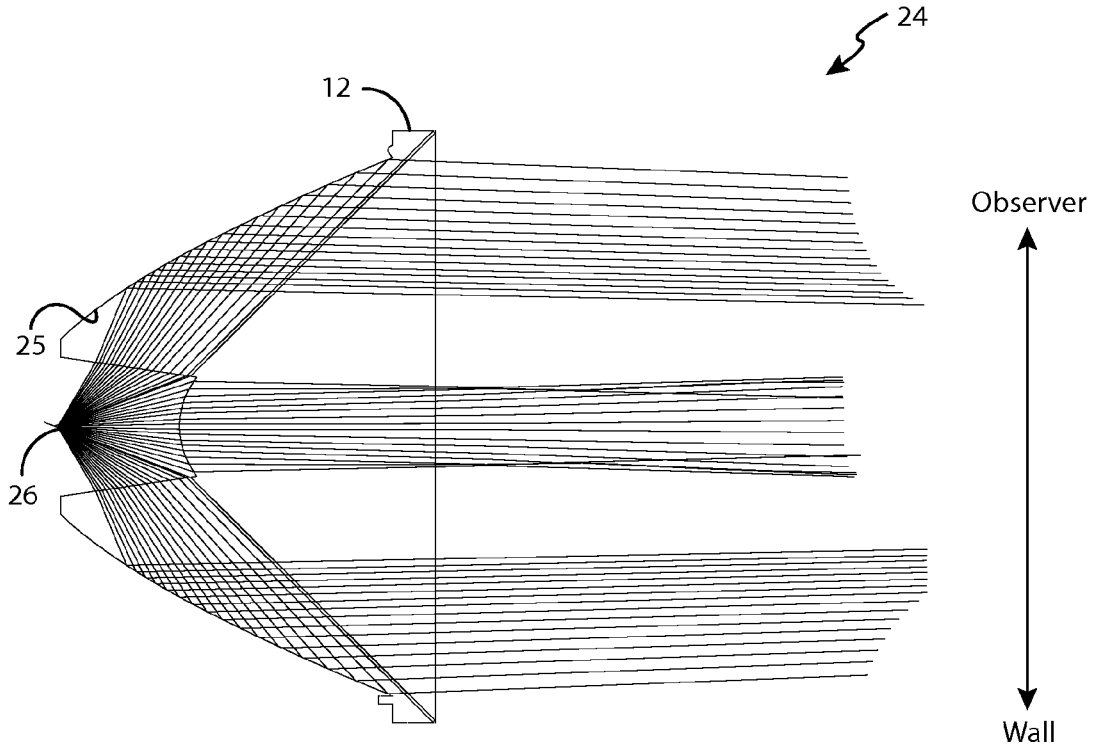
FIG. 2 includes a detailed schematic cross-sectional diagram of a symmetric TIR optic illustrated in FIG. 1.

FIG. 2 includes a detailed schematic cross-sectional diagram of symmetric TIR optic 12 illustrated in FIG. 1. Referring to FIG. 2, symmetric TIR optic 12 includes light source 26, which emits light into symmetric TIR optic 12. By reflection of the emitted light from inner walls 25 of symmetric TIR optic 12, light pattern 24 is generated and emitted from symmetric TIR optic 12. As illustrated in FIG. 2, the light pattern 24 emitted by symmetric TIR optic 12 propagates with equal intensity in the direction toward wall 22 and in the direction away from wall 22 toward an "observer" some distance away from wall 22. The light toward the observer, referred to as "glare," is light that is not directed onto the target surface. Thus, in these conventional systems, the coefficient of utilization, which is related to the ratio of the light onto the wall to the total light out of the illumination system, is relatively low.

Figure 3:
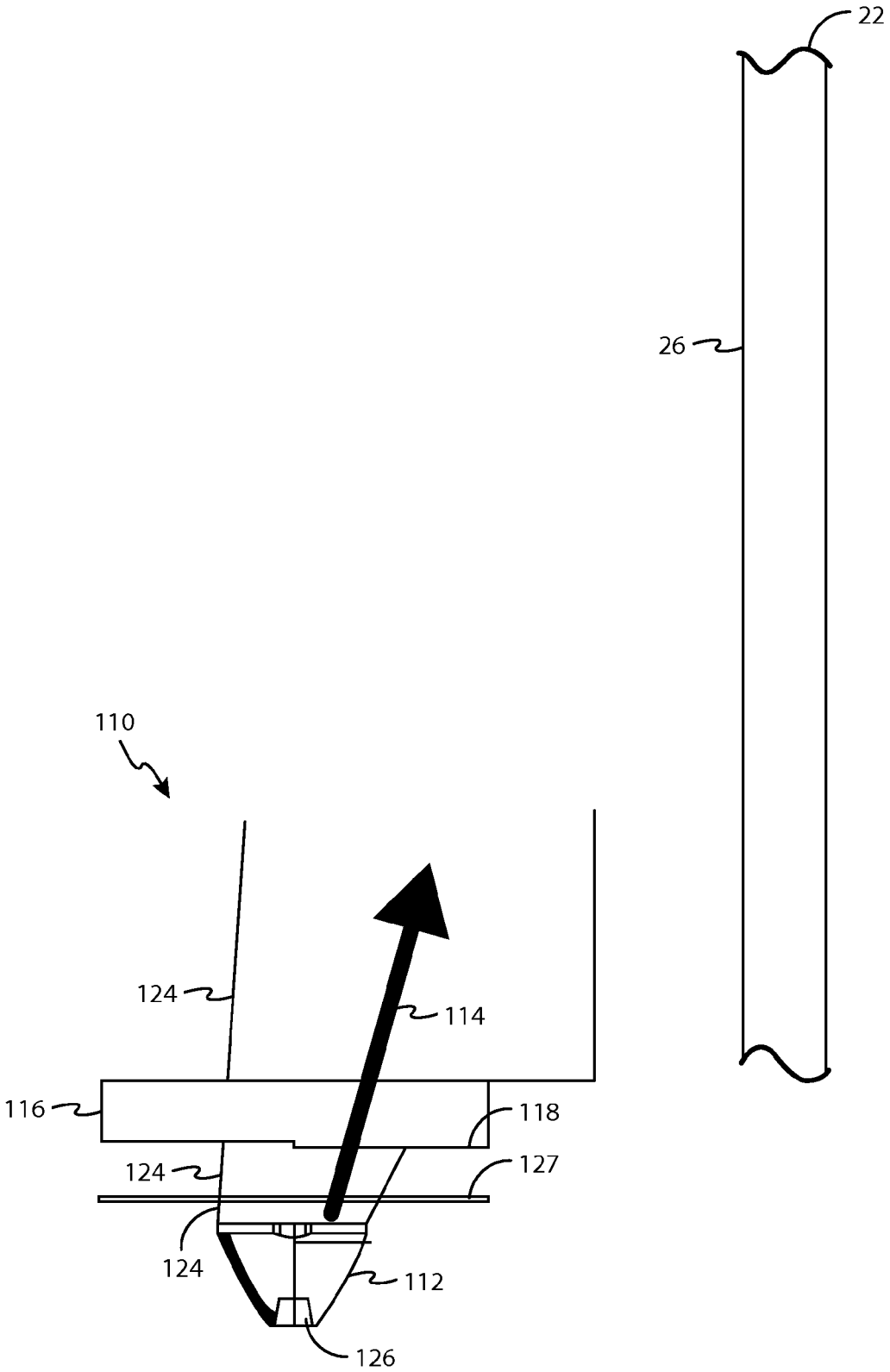
FIG. 3 includes a schematic cross-sectional view of a wall wash lighting system, according to some exemplary embodiments.

According to exemplary embodiments described in detail herein, a wall wash illumination system which achieves a more uniform illumination of a wall is provided. FIG. 3 includes a schematic cross-sectional view of a wall wash lighting system 110, according to some exemplary embodiments. Referring to FIG. 3, wall wash lighting system 110 includes an asymmetric total internal reflection (TIR) optic 112, in contrast with the symmetric TIR optic 12 of the conventional system 10 illustrated in FIGS. 1 and 2. Asymmetric TIR optic 112 emits a light pattern 124 having a primary direction as illustrated by arrow 114 to illuminate surface 20 of wall 22. Asymmetric TIR optic 112 includes a light source 126, such as an LED light source, which emits light 124 primarily along the direction indicated by arrow 114. The light emitted by TIR optic 12 passes through a diffuser 127, which in some exemplary embodiments is an elliptical diffuser. Diffuser 127 diffuses light 124 in both the vertical and horizontal dimensions such that a more uniform illumination of surface 20 in both dimensions is achieved. Light from diffuser 127 passes through a glass cover lens 116, which can include an etched portion 118. Etched portion 118 of cover lens 116 diffuses the light such that the light is emitted from system 110 in light pattern 124. The etched portion 118 of cover lens 116 primarily directs a portion of the light out of system 110 toward the portion of the wall closest to system 110. That is, in the exemplary illustration in which system 110 is located near a lower portion of wall 22, etched portion 118 of cover lens 116 directs a portion of the light out of system 110 primarily toward the bottom portion of wall 22, thus eliminating dark spots near the bottom of wall 22.

According to the exemplary embodiments, the asymmetric TIR optic 112, elliptical diffuser 127 and partially etch cover lens 116 provide illumination more suitable to providing uniform illumination of surface 20 of wall 22 than prior systems, such as system 10 illustrated in FIGS. 1 and 2. According to the exemplary embodiments, this improved illumination profile is achieved without the need to tilt any of the system components, as is commonly done in conventional wall wash illumination systems. Furthermore, a higher portion of the output light from the illumination system 110 is directed onto the wall. That is, an increased coefficient of utilization is realized by illumination system 110 of the present disclosure.

Figure 4:
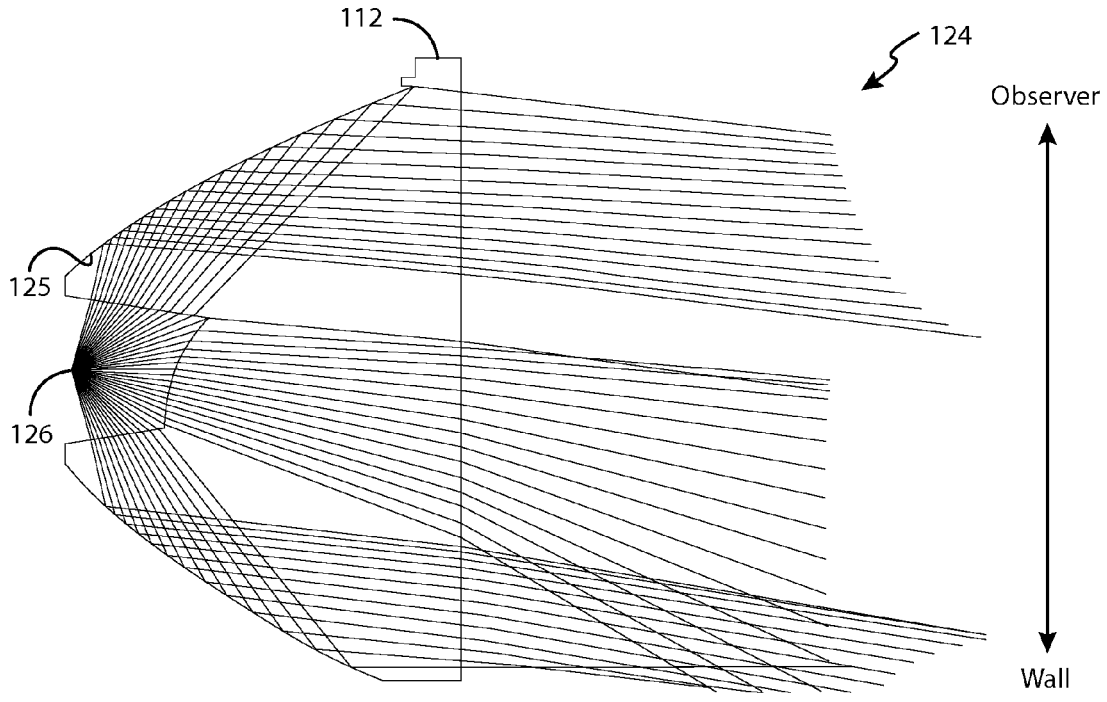
FIG. 4 includes a detailed schematic cross-sectional diagram of an asymmetric TIR optic illustrated in FIG. 3, according to some exemplary embodiments.

FIG. 4 includes a detailed schematic cross-sectional diagram of asymmetric TIR optic 112 illustrated in FIG. 3. Referring to FIG. 4, asymmetric TIR optic 112 includes light source 126, which in some exemplary embodiments is an LED light source. Light source 126 emits light into asymmetric TIR optic 112. By reflection of the emitted light from inner walls 125 of asymmetric TIR optic 112, light pattern 124 is generated and emitted from asymmetric TIR optic 112. As illustrated in FIG. 4, the light pattern 124 emitted by asymmetric TIR optic 112 is asymmetric in that more of the light 124 propagates in the direction toward wall 22 than in the direction away from wall 22 toward an "observer" some distance away from wall 22.

Figure 5:
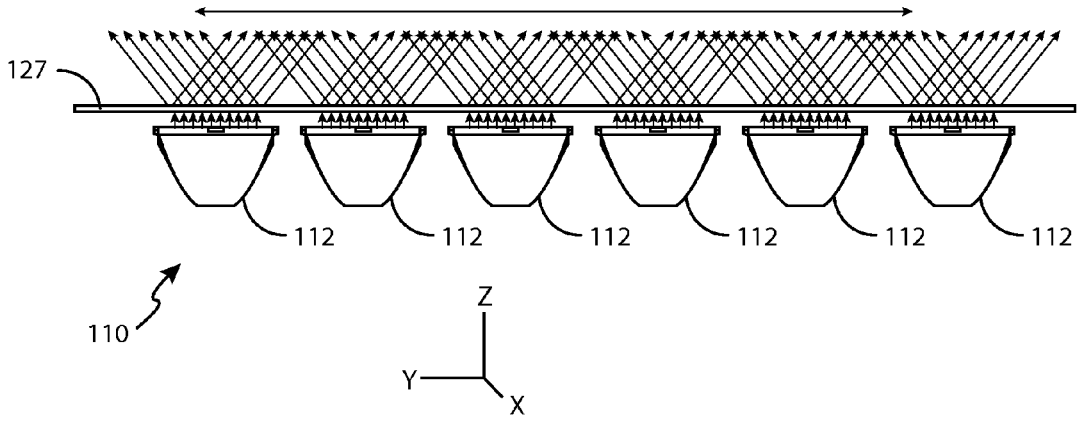
FIG. 5 includes a schematic cross-sectional view of a portion of the wall wash illumination system illustrated in FIG. 3, rotated 90 degrees from the view of FIG. 3, according to some exemplary embodiments.

FIG. 5 includes a schematic cross-sectional view of a portion of the wall wash illumination system 110 illustrated in FIG. 3, rotated 90 degrees from the view of FIG. 3, according to some exemplary embodiments. Referring to FIG. 5, light from the plurality of asymmetric TIR optics 112 is diffused by diffuser 127, as illustrated by the light ray arrows in FIG. 5. As described above, diffuser 127 diffuses light 124 in both the vertical Z dimension and the horizontal Y dimension, such that a more uniform illumination of surface 20 in both dimensions is achieved.

In some exemplary embodiments, diffuser 127 is an elliptical diffuser. As such, the amount of diffusion or diffusion angle in each dimension provided by diffuser 127 can be different and can be selected as needed for the particular wall wash illumination application. That is, given a particular wall height and setback, i.e., lateral distance between system 110 and wall 22, characteristics of diffuser 127 and, therefore, the amount of diffusion in each dimension, are selectable according to the desired wall wash illumination effect.

For example, one particular exemplary elliptical diffuser 127 may be a 50×3 diffuser, in which the diffusion angle in the Y dimension, i.e., side-to-side on the wall, is 50 degrees and the diffusion angle in the Z dimension, i.e., up and down the wall, is 3 degrees. In certain applications, i.e., wall height, setback, etc. this elliptical diffuser might provide light that is spread evenly across the wall horizontally. The 3-degree Z dimension would also help to improve the light uniformity up and down the wall. However, such a distribution may only be ideal for one particular setback and one particular wall height. For example, for a shorter wall, with this diffuser, more light might be lost or might illuminate a ceiling or other surface or object above the wall. Also, if the setback is greater, then there may not be enough light at the base of the wall.

According to the exemplary embodiments, this diffuser 127 can be switched for a different diffuser with wider diffusion in the small, i.e., vertical Z, dimension. For example, the 50×3 diffuser may be replaced with a 50×5 or a 50×10 diffuser. The result would be to move the region of the highest illuminance up and down the wall.

Thus, according to the present disclosure, optimal wall wash illumination is achieved by system 110 for virtually any wall wash application. That is, virtually every wall wash configuration, with wide ranges of wall heights and/or setbacks, is accommodated by the system 110 of the present disclosure by changing out different diffusers 127.

Figure 6:
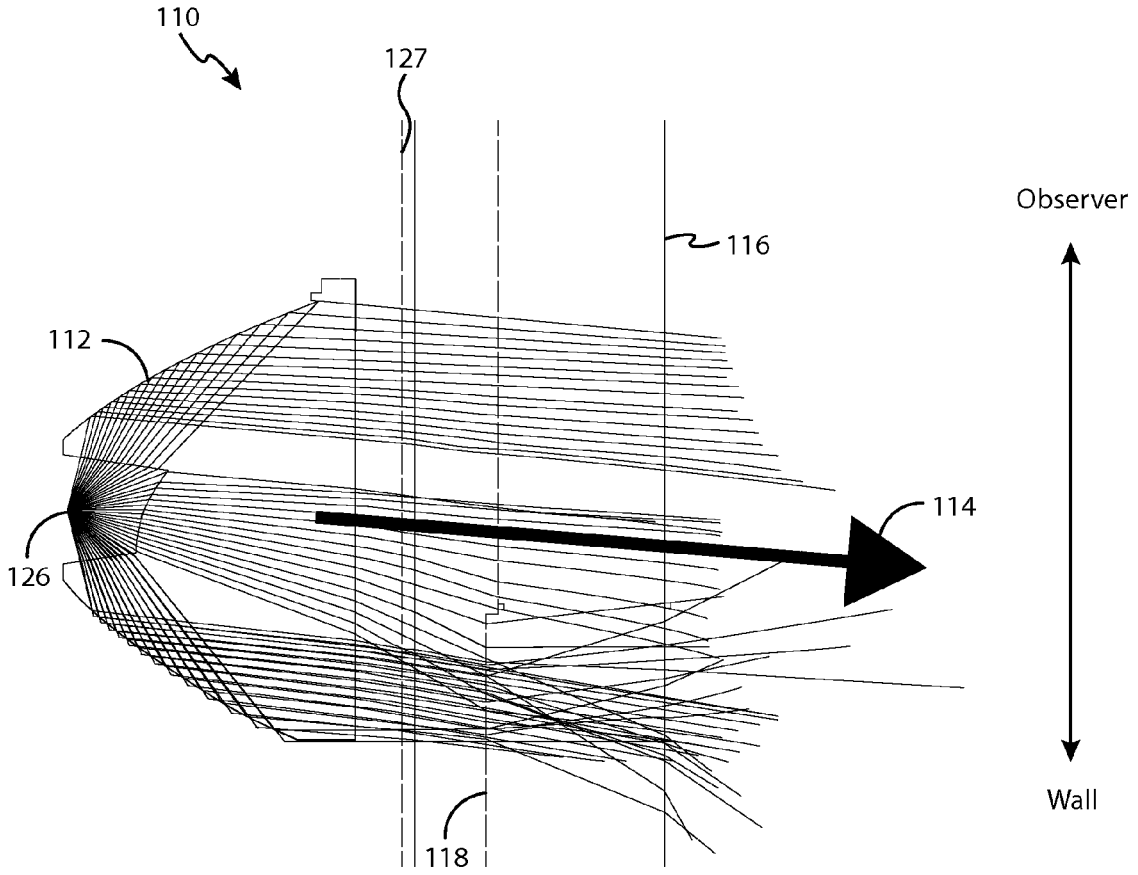
FIG. 6 includes a schematic diagram (ray trace) of a wall wash illumination system, according to some exemplary embodiments.

FIG. 6 includes a schematic diagram (ray trace) of wall wash illumination system 110, according to some exemplary embodiments. Referring to FIG. 6, light source 126 provides light into asymmetric TIR optic 112, which, by internal reflection, provides an asymmetric light pattern to diffuser 127. Based on the selected characteristics of diffuser 127, as described above in detail, diffuse light passes through cover lens 116. The portion of the light which passes through the etched portion 118 of cover lens 116 is further scattered. The resulting asymmetric light pattern emitted by system 110 has greater intensity in the direction toward the wall than in the direction away from the wall. As a result, improved, more uniform wall wash illumination is achieved.

Figure 7A:
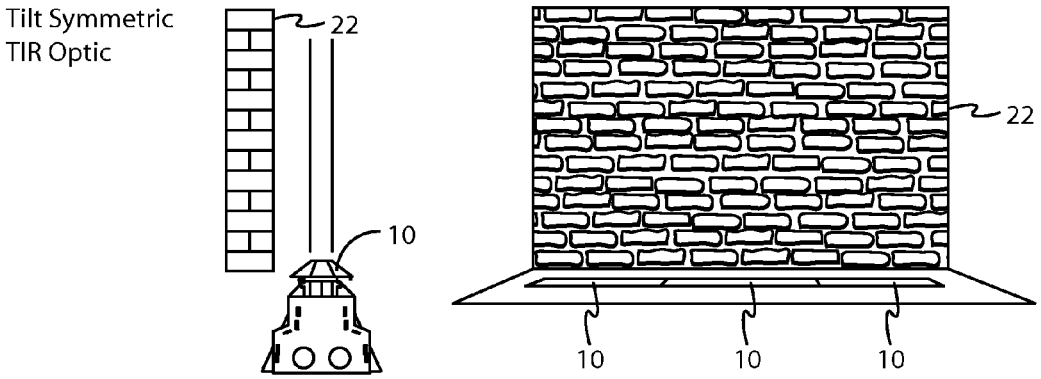
FIGS. 7A and 7B include schematic diagrams of a conventional wall wash illumination system and a wall wash system according to the exemplary embodiments, respectively, used to illuminate a wall.
Figure 7B:
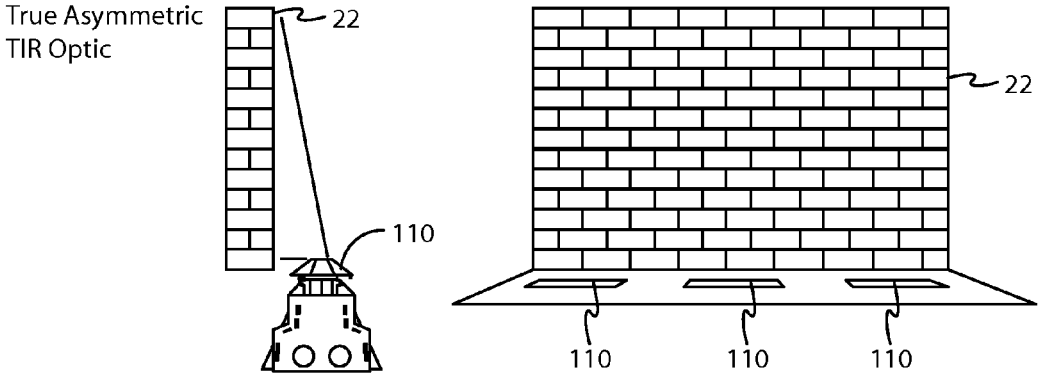

FIGS. 7A and 7B include schematic diagrams of a conventional wall wash illumination system and a wall wash system according to the present disclosure, respectively, used to illuminate a wall. Specifically, FIG. 7A illustrates a conventional symmetric TIR "tilt" optic system, such as system 10 illustrated in FIG. 1, installed in the ground at a setback distance from wall 22. Specifically, FIG. 7A illustrates three systems 10 being used to provide wall wash illumination on wall 22. FIG. 7B illustrates a true asymmetric TIR optic system of the present disclosure, such as system 110 illustrated in FIGS. 3-6 and described above in detail, installed in the ground at a setback distance from wall 22. Specifically, FIG. 7B illustrates three systems 110 being used to provide wall wash illumination on wall 22. It will be understood that, although the schematic illustrations of FIGS. 7A and 7B show systems 110 in the ground and emitting light primarily vertically, the present disclosure is completely applicable to any other configuration. For example, systems 110 need not be located in the ground. Also, the systems 110 may be located anywhere along the wall 22 and may direct light anywhere, as needed. For example, systems 110 could also be located at or near the top of wall 22 and may direct light primarily in the downward direction to illuminate wall 22. FIGS. 7A and 7B are intended to illustrate any other orientations.

As noted from FIG. 7A, the conventional systems 10 provide wall wash illumination which is not uniform and which casts shadows of some wall features onto other portions of the wall 22. In contrast, as noted from FIG. 7B, the systems 110 of the present disclosure provide a more uniform wall wash illumination. Shadows and dark regions are eliminated, to the point that the wall 22 of FIG. 7B takes on a two-dimensional flat appearance.

Figure 8A:
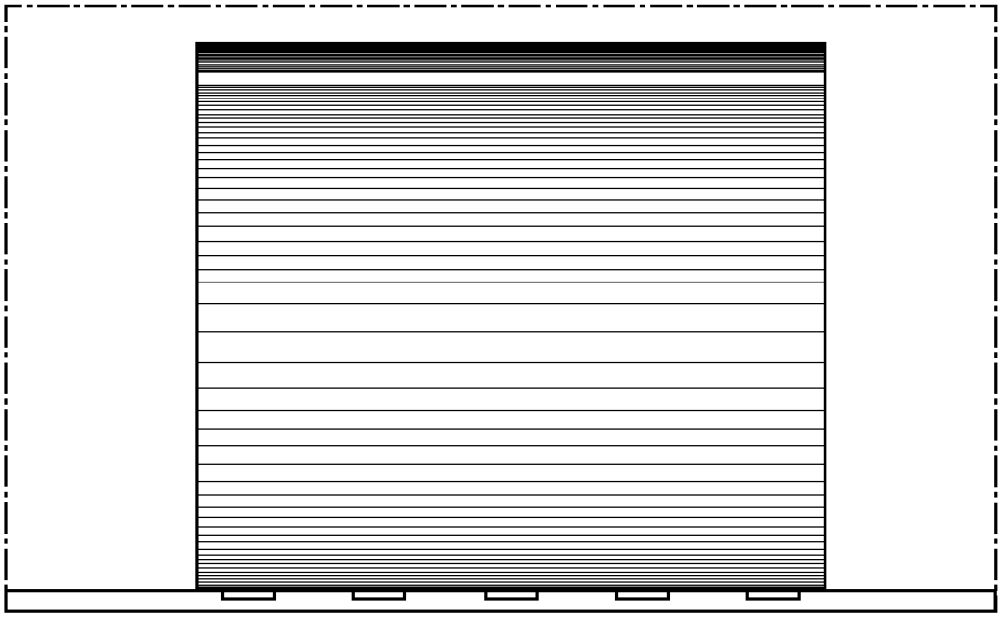
FIGS. 8A and 8B include images which illustrate the wall wash illumination provided by a conventional wall wash illumination system and the wall wash illumination system according to the exemplary embodiments, respectively.
Figure 8B:
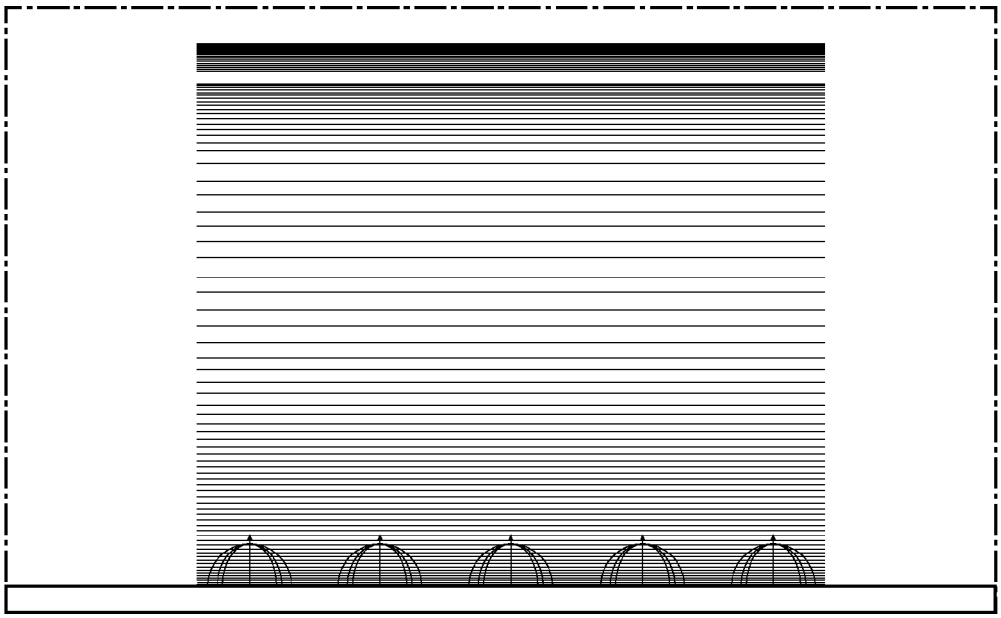

FIGS. 8A and 8B include images which illustrate the wall wash illumination provided by the conventional wall wash illumination system 10 and the wall wash illumination system 110 according to the present disclosure, respectively. Referring to FIG. 8A, the tilted-symmetric-optic-based illumination creates "hot spot" regions of high intensity on the wall and leaves dark spots on the upper portion of the wall and at the base of the wall. Referring to FIG. 8B, the asymmetric-optic-based system 110 of the present disclosure creates an evenly illuminated wall with a majority of the light on the target surface. The asymmetric TIR optic 112 directs light toward the top of the wall, the elliptical diffuser 127 spreads it along the wall, and the partially etched portion 118 of the cover lens 116 gets light to the base of the wall.

It is noted that the exemplary embodiments of the wall wash illumination system 110 of the present disclosure are described in detail herein as being configured as one or more linear arrays of light sources in one or more fixtures which are disposed in the ground and which illuminate a nearly vertical wall adjacent to the one or more fixtures, the longitudinal axis of the one or more fixtures being oriented substantially parallel to the surface of the wall being illuminated. It will be understood that this configuration is exemplary only and is used for the purpose of conveying an understanding of the principles of the disclosure. The present disclosure contemplates and is intended to cover other configurations. For example, the illumination system including the one or more fixtures need not be located in the ground. They also need not be located at the base or bottom of the illuminated surface. They may be located anywhere along the illuminated surface, including but not limited to, near the top of a wall, with the light being emitted from the illumination system including the one or more fixtures in the downward direction. Furthermore, the present disclosure also contemplates and is intended to cover any number of light sources, including a single light source, arranged in any configuration, i.e., not necessarily as a plurality of sources in a linear array.

Whereas many alterations and modifications of the disclosure will no doubt become apparent to a person of ordinary skill in the art after having read the foregoing description, it is to be understood that the particular embodiments shown and described by way of illustration are in no way intended to be considered limiting. Further, the subject matter has been described with reference to particular embodiments, but variations within the spirit and scope of the disclosure will occur to those skilled in the art. It is noted that the foregoing examples have been provided merely for the purpose of explanation and are in no way to be construed as limiting of the present disclosure.

While the present inventive concept has been particularly shown and described with reference to exemplary embodiments thereof, it will be understood by those of ordinary skill in the art that various changes in form and details may be made therein without departing from the spirit and scope of the present inventive concept as defined by the following claims.

The invention claimed is:

1. An illumination system for illuminating a surface, comprising:

an optical source for generating light;

an asymmetric optic device for generating output light by total internal reflection (TIR) of the light from the optical source, the asymmetric optic device having an axis, intensity of the output light being asymmetric with respect to the axis of the asymmetric optic device;

a diffuser receiving and diffusing the output light from the asymmetric optic device to generate diffused light; and a cover lens receiving the diffused light from the diffuser and generating an output light pattern from the diffused light from the diffuser that is transmitted through the cover lens, the cover lens having an etched portion and a non-etched portion, the etched portion of the cover lens asymmetrically scattering only a portion of the diffused light that is transmitted through the cover lens to generate the output light pattern such that the output light pattern has an intensity profile that is asymmetric with respect to the axis of the asymmetric optic device; wherein the surface being illuminated is substantially parallel to the axis of the asymmetric optic device.

2. The illumination system of claim 1, wherein the illumination system is a wall wash illumination system.

3. The illumination system of claim 1, wherein the illumination system is located near a lower portion of the surface being illuminated, and the output light pattern is directed primarily in an upward direction.

4. The illumination system of claim 1, wherein the illumination system is located near an upper portion of the surface being illuminated, and the output light pattern is directed primarily in a downward direction.

5. The illumination system of claim 1, wherein the surface being illuminated is a surface of a wall.

6. The illumination system of claim 5, wherein the illumination system is vertically located beneath ground level.

7. The illumination system of claim 6, wherein the axis of the asymmetric optic device is substantially perpendicular to a surface of the ground in which the illumination system is located.

8. The illumination system of claim 5, wherein the illumination system is located near a lower portion of the wall, and the output light pattern is directed primarily in an upward direction.

9. The illumination system of claim 5, wherein the illumination system is located near an upper portion of the wall, and the output light pattern is directed primarily in a downward direction.

10. The illumination system of claim 1, wherein the diffuser is an elliptical diffuser.

11. The illumination system of claim 1, wherein the optical source comprises a light-emitting diode (LED).

* * * * *